US011013277B1

(12) United States Patent
Alhumood

(10) Patent No.: US 11,013,277 B1
(45) Date of Patent: May 25, 2021

(54) MASK WITH FILTER PORT

(71) Applicant: Khaldoon Alhumood, Safat (KW)

(72) Inventor: Khaldoon Alhumood, Safat (KW)

( * ) Notice: Subject to any disclaimer, the term of this patent is extended or adjusted under 35 U.S.C. 154(b) by 0 days.

(21) Appl. No.: 17/086,707

(22) Filed: Nov. 2, 2020

(51) Int. Cl.
*A41D 13/11* (2006.01)
*A62B 23/02* (2006.01)

(52) U.S. Cl.
CPC ..... *A41D 13/1107* (2013.01); *A41D 13/1161* (2013.01); *A62B 23/02* (2013.01)

(58) Field of Classification Search
CPC .... A61M 16/06–0655; A61M 16/0683; A61M 2016/0661; A62B 7/10; A62B 18/02; A62B 18/084; A62B 18/088; A62B 23/00–02; A41D 13/11–1192
See application file for complete search history.

(56) References Cited

U.S. PATENT DOCUMENTS 2,665,686 A * 1/1954 Wood ..... A61F 9/028 128/206.12
2,741,246 A * 4/1956 Litchfield ..... A62B 18/02 128/201.13
3,152,588 A * 10/1964 Rogowski ..... A62B 18/02 128/206.12
4,414,973 A * 11/1983 Matheson ..... A62B 18/00 128/206.15
4,832,017 A * 5/1989 Schnoor ..... A61M 16/06 128/206.12
2017/0128754 A1* 5/2017 Hou ..... A62B 23/025
2018/0256926 A1* 9/2018 Kyung ..... A62B 18/088
2020/0114178 A1* 4/2020 Waterford ..... A62B 23/025

* cited by examiner

*Primary Examiner* — Rachel T Sippel
(74) *Attorney, Agent, or Firm* — Nath, Goldberg & Meyer; Richard C. Litman

(57) ABSTRACT

A mask with filter port is configured to cover a wearer's nose and mouth to protect the wearer from airborne microbes in the environment and/or minimize a risk of spreading airborne microbes from the user. The mask with filter port includes a substantially arcuate body wall, a slanted base at a lower end of the wall, an elastomeric seal extending from a face edge of the wall, a filter holder secured to the slanted base, and a pair of securing straps connected to the body wall. The elastomeric seal provides an interface between the body wall and the user's face. The securing straps secure the mask against the user's face, with the elastomeric seal pressing against the user's face.

1 Claim, 2 Drawing Sheets

MASK WITH FILTER PORT

BACKGROUND

1. Field

The disclosure of the present patent application relates to face masks, and particularly to a face mask with a filter to reduce respiratory transmission of disease and provide other respiratory filtration.

2. Description of the Related Art

Certain infectious diseases, such as COVD-19, which is caused by severe acute respiratory syndrome coronavirus 2 (SARS-CoV-2), are readily spread through exhaled droplets and aerosols. Although social distancing has proven effective at mitigating the spread of such diseases, social distancing can be difficult to implement in the workplace, schools, and other public areas.

In the case of coronavirus infections, such as COVID-19, micro-droplets are a primary means of transmission. Consequentially, filters targeting droplet transmission are effective when worn by a potentially contagious person, although there is also some benefit to the wearer.

Thus, a face mask solving the aforementioned problems is desired.

SUMMARY

A mask with filter port is configured to cover a wearer's nose and mouth to protect the wearer from airborne microbes in the environment and/or minimize a risk of spreading airborne microbes from the user. The mask with filter port includes a substantially arcuate body wall, a slanted base at a lower end of the wall, an elastomeric seal extending from a face edge of the wall, a filter holder secured to the slanted base, and a pair of securing straps connected to the body wall. The elastomeric seal provides an interface between the body wall and the user's face. The securing straps secure the mask against the user's face, with the elastomeric seal pressing against the user's face.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
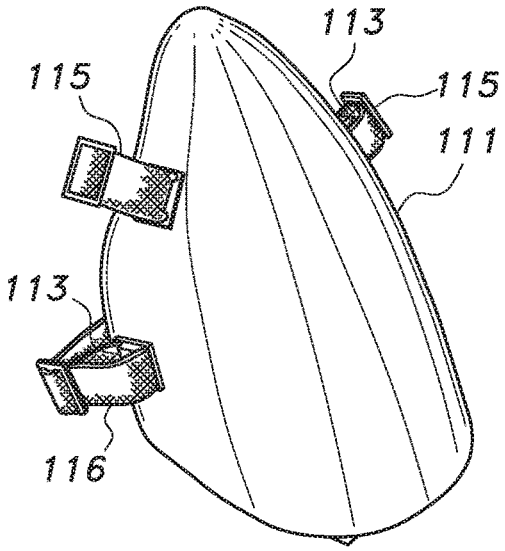
FIG. 1 is a perspective view of an embodiment of the face mask according to the present teachings.

A face mask with filter port includes a slanted base, an arcuate, molded body wall extending upright from the base, a filter support positioned on the slanted base, and a plurality of securing straps connected to the wall. The body wall has a face edge that borders a first opening into the interior of the mask and an opposing rear edge that extends below the face edge. The slanted base extends between the face edge and the rear edge A second opening into the interior of the mask is defined in the base. The filter support can be disposed over the second opening. A soft face seal extends along the face edge of the mask wall. In an embodiment, an angle formed between the face edge and the slanted base is about 20°. The filter support is removably connected to the base of the mask such that the filter support is also slanted with respect to the face edge of the mask wall. A replaceable filter can be disposed on the filter support. The mask body is substantially impermeable and can be easily cleaned or disinfected after use. The replaceable filters can be disposable filters or readily cleaned filters. As such, the mask also allows convenient exchange of used filters with fresh filters, and convenient exchange of filters having different flow and filtration levels.

When worn, the mask with filter port is configured to cover a wearer's nose and mouth to protect the wearer from airborne microbes in the environment and/or minimize a risk of spreading airborne microbes from the user. The mask is configured such that an air space exists between the user's face and the mask wall when the mask is secured to the user's face. The filter support is downward-facing so that breathing results in exhaled air being directed in a downward direction. The filter disposed on the filter support is replaceable, which allows replacement without swapping out masks. The filter media provides an air exchange surface and directs air in a 20° inclination from the vertical. The mask wall itself is substantially impermeable to airborne microbes so that air can only pass through the filter holder.

The filter support holds filter media along a plane that is positioned horizontally and downward facing, or obliquely from the horizontal. This can allow air to flow through the filter vertically downward or downward at a corresponding oblique angle from the horizontal; i.e., normal to the plane of the filter.

The configuration of the mask conforms to the natural design of a human nose, where the air exchange surface is inclined downward, with a 20° inclination. This slanted position of the filter reduces the chance of infection by large droplet transmission. This is particularly advantageous in that inhaled and exhaled air is directed in a substantially vertical direction, which makes it more difficult to transmit droplets.

While an inclination angle of 20° is described, it is understood that this is approximate. The general concept is to have the filter face in the downward direction. It is anticipated that wider ranges of inclination will be used according to design choice, such as minimum angles of 0°, 5°, 10° and 20°, and maximum angles of 30°, 40° or 50°. The downward direction is believed to re-direct airborne microbes, e.g., droplets and particles, so that fewer droplets or particles enter the mask and droplets expelled from the mask are directed downward so as not to expose other people to the droplets.

As the filter support is disposed on a rear surface of the base, the filter support is at a convenient location for replacement. The filter support is provided as a shelf-like apparatus that is removably positioned on the base. For example, an outer frame of the filter support can be slidably inserted within a groove on the base of the mask. The filter support can include a perforated filter box and a perforated door pivotally connected to the box. Once the door is opened, a disposable or reusable filter can be disposed or removed from the box. If desired, a used filter can be replaced without removing the mask. In appropriate circumstances, activated charcoal and similar materials can be incorporated into the filtration.

The mask wall may be provided as a molded body or re-formable shell that allows adjustment of a shape of the wall after manufacture to conform the mask to a shape in conformity to an individual's facial features.

In order to seal the mask against the face and to enhance comfort, an elastomeric seal or a silicone seal is provided along the face edge where the mask interfaces with the wearer's face. It is alternatively possible to use a different elastomeric or soft material as the seal. The seal can be press fit over the edge of the shell of the mask, bonded to the shell of the mask, or the mask can be made of a bi-material plastic, with the seal extending from the shell as a soft elastomeric lip, tube or pad. The seal can form a large cushion area or can flare from the shell as a lip seal. It is possible to form the seal from soft reticulated foam material with a non-reticulated cover, or as a hollow resilient tube.

The mask is secured to the head by the straps. In a non-limiting example two straps are used to fasten the mask to the back of the head. Alternatively, the same configuration can be used with four straps, with two on each side. In the four-strap arrangement opposing pairs of straps can be tied together. The straps are preferably elastic and adjustable in length. The straps are configured to gently retain the mask against the face at a pressure determined by the adjustment of the straps. Other strap arrangements, such as an over the head strap, can be used.

After using the mask, the user can remove the mask and, if necessary, clean it with disinfectant materials and wash it with soap and water to be used again. The filter is removable, so it can be left dry, washed separately or replaced.

The filter material itself can be of any convenient filter media. The particular filter would depend on the target filtration, so that in circumstances in which physical distancing is sufficient for safety from airborne droplet transmission, a low density filter can be used, but it is also possible to approximate N-95 filtration with appropriate filter media for more effective filtration. As a non-limiting example, MERV 12 or 13 filters are sometimes considered to approximate the filtration of an N-95 mask. The ability to interchange filters is convenient in circumstances in which the user expects to be in different environments in which different levels of filtration are needed. This allows the user to have a desired level of filtration, but use the same mask with a less dense filter for ease of use in locations where less effective filtration is tolerable.

The mask wall can have a fixed molded shape or have a predetermined degree of flexibility. It is also possible to provide the molded body with re-formable material, so that the mask can be formed to a desired shape to conform to the user's face contour. One non-limiting technique to permit such adjustment is to use a material which softens when moderately heated and carefully positioning the mask on the individual user's face while being careful not to cause harm to the user. This can be accomplished by heating the mask and allowing the molded body to deform, or by otherwise curing the molded body in a desired shape. An alternative technique allows final curing of the material, for example using actinic light. Since the silicone seal does not permanently deform under temperatures suitable for softening or curing the molded body, the silicone seal retains its function after the molded body is formed.

Figure 2:
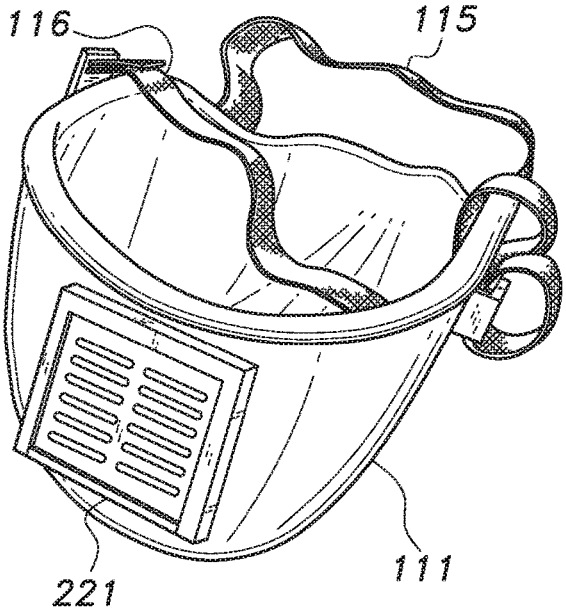
FIG. 2 is a bottom view of an embodiment of the face mask according to the present teachings.
Figure 3:
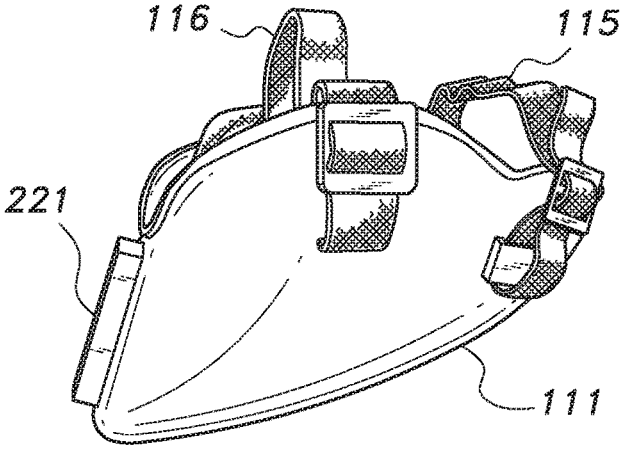
FIG. 3 is a side view of an embodiment of the mask according to the present teachings.
Figure 4:
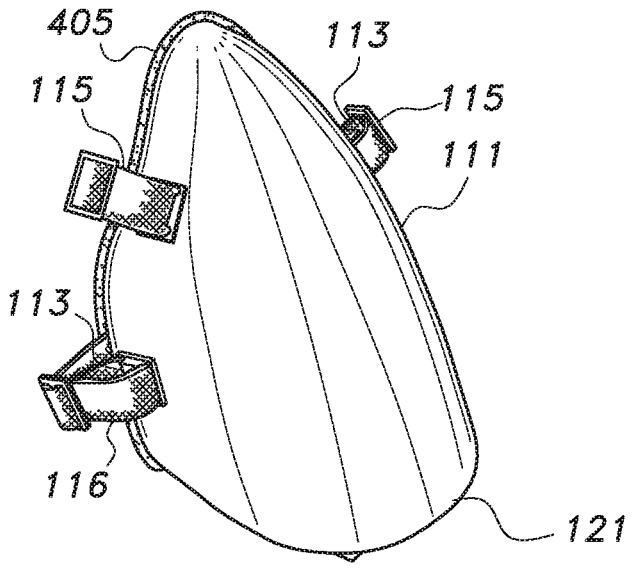
FIG. 4 is a top view of an embodiment of the face mask according to the present teachings.
Figure 5:
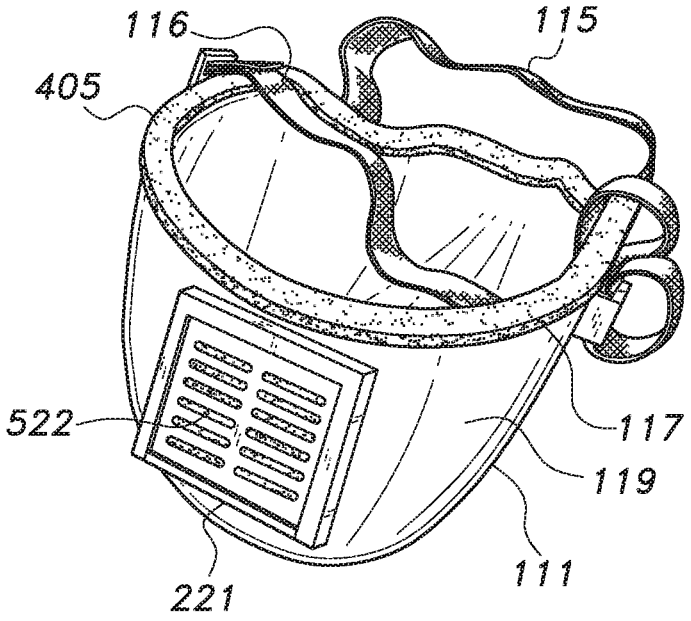
FIG. 5 is a bottom view of an embodiment of the face mask according to the present teachings.

The FIGS. 1-5 depict the mask according to the present teachings. The mask includes a body wall 111 with loop holes 113 provided for receiving straps 115, 116 therethrough. The wall 111 has an arcuate face edge 117 and a rear edge 121 extending below the face edge at an angle, as depicted in FIG. 4. The mask base 119 extends between the face edge 117 and the rear edge 121, at an angle from the face edge 117, as best seen in FIG. 5, wherein an acute angle is illustrated in FIG. 3.

FIG. 2 is a bottom view of the mask of FIG. 1. FIG. 3 is a side view of the mask of FIG. 1, showing the filter support 221. Filter support 221 includes a box and a door pivotally connected to the box. The filter support 221 is secured to the slanted base 119, as best seen in FIGS. 3 and 5, and positioned at an angle of approximately 20° inclination from the face edge 117 of the mask.

FIG. 4 is a top oblique view of the mask of FIGS. 1-3, incorporating a silicone seal 405. FIG. 5 is a bottom view of the mask, showing silicone seal 405 and filter media 522 inserted into filter support 221.

It is to be understood that the face mask with separate inhaling and exhaling portions is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A face mask consisting of:

an arcuate body wall, the body wall consisting of:

an imperforate front face that is configured to cover a user's nose and mouth, a curved face edge, a rear edge extending from a lower end of the face edge, and a slanted base extending between the face edge and the rear edge at an acute angle to the arcuate body wall, the slanted base having a single opening therein;

a filter support secured to the slanted base over the single opening, wherein the filter support is downward-facing so that breathing results in exhaled air being directed in a downward direction;

a disposable filter secured to the filter support;

an elastomeric seal extending along the curved face edge; and a plurality of securing straps connected to the arcuate body wall, the straps configured to secure the mask against the user's face.

* * * * *